US005319409A

United States Patent [19]

Fleck et al.

[11] Patent Number: 5,319,409

[45] Date of Patent: Jun. 7, 1994

[54] ARRANGEMENT FOR DEVELOPING PHOTOGRAPHIC SHEET CARRIERS

[75] Inventors: Adolf Fleck, Unterhaching; Horst Köninger, Munich, both of Fed. Rep. of Germany

[73] Assignee: Agfa-Gevaert AG, Leverkusen, Fed. Rep. of Germany

[21] Appl. No.: 911,982

[22] Filed: Jul. 10, 1992

[30] Foreign Application Priority Data

Aug. 2, 1991 [DE] Fed. Rep. of Germany ..... 9109565

[51] Int. Cl.[5] ..... G03D 3/08

[52] U.S. Cl. ..... 354/324; 354/312

[58] Field of Search ..... 354/319-324, 354/310, 311, 331, 336, 312

[56] References Cited

U.S. PATENT DOCUMENTS

| | | | |
|---|---|---|---|
| 4,743,928 | 5/1988 | Young | 354/310 |
| 4,857,949 | 8/1989 | Masuda et al. | 354/322 |
| 5,003,335 | 3/1991 | Müller et al. | 354/312 |

*Primary Examiner*—D. Rutledge

*Attorney, Agent, or Firm*—Michael J. Striker

[57] ABSTRACT

An arrangement for developing photographic sheet carriers in daylight operation has a closeable receiving container, a chamber with a plurality of treatment baths, an input table through which a sheet carrier is transported to the treatment baths, a transporting element for transporting the sheet carrier through the treatment baths, a drier supplying an air stream to the sheet carrier and having a suction, a light-tight ventilating device provided in the chamber with the treatment baths and located close to the input table, wherein the chamber with the treatment baths is connected with the suction side of the drier.

6 Claims, 1 Drawing Sheet

ARRANGEMENT FOR DEVELOPING PHOTOGRAPHIC SHEET CARRIERS

BACKGROUND OF THE INVENTION

The present invention relates to an arrangement for developing photographic sheet carriers in a daylight operation.

More particularly it relates to an arrangement for developing a photographic sheet carrier in daylight operation, with a closeable receiving container, an input table with which the sheet carrier is transferred from an input cassette into a chamber with chemical treatment baths, a transporting device for transporting the sheet carrier through several treatment baths, and a drier in which an air stream is supplied to the sheet carrier by a blower.

Arrangements of the above mentioned general type are known in the art. In a known arrangement the vapor from the development baths escapes through the supply slot for the photographic sheet carrier and is condensed on the input table. The quantity of condensate is especially a problem when the developing machine operates with a high development temperature of approximately 40° C. The condensate on the one hand can act for adhering of the sheet carrier to the input table and thereby lead to transportation disturbances, and on the other hand it can cause a predevelopment and thereby a lower quality of the end products. Especially in the development machines which are used for graphic crafts, it cannot be acceptable in any case.

SUMMARY OF THE INVENTION

Accordingly, it is an object of the present invention to provide an arrangement for developing photographic sheet carriers which avoids the disadvantages of the prior art.

More particularly, it is an object of the present invention to provide an arrangement for developing photographic layer carriers in which the above mentioned condensate formation is prevented during an operation with high development temperatures.

In keeping with these objects and with others which will become apparent hereinafter, one feature of the present invention resides, briefly stated, in an arrangement for developing photographic sheet carriers in which the chamber with the chemical treatment baths has a light-tight ventilating device located in the immediate vicinity to the input table and connected with a suction side of a drying blower.

In the development machine of this type, there is a difference between a so-called stand-by process in which the baths are maintained at a temperature and the drier does not operate, and the development process. In the stand-by process the baths are not moved, and the evaporation rate especially of the development baths is relatively low. For this type of operation it is sufficient to withdraw the produced vapor to the atmosphere through the light-tight ventilation openings in the vicinity of the input table. During the development process the baths are constantly moved by the introduced material and the increased circulation, and the evaporation rate increases erratically.

In order to prevent also a condensate formation on the input table, in accordance with the present invention a slight negative pressure is produced by the rotating drying blower over the chemical baths. The fraction of the development vapor in the aspirated air is so low that in the dryer it does not affect the quality of the photographic material in disadvantageous fashion.

In accordance with an especially advantageous embodiment of the present invention, the cover of the input cassette is double walled and therefore a hollow chamber is produced between the inner wall and the outer wall. The cover is formed so that the open end side of the hollow chamber lies on the covering for the treatment baths. The vapor containing waste air can thereby pass through the ventilation openings in the covering into the hollow chamber of the cover and from there through the ventilation slot in the outer wall of the cover outwardly.

The ventilation openings in the covering for the baths can be provided in a synthetic plastic strip which subsequently can be mounted on the covering.

The double walled cover of the input cassette can be formed so that the hollow chamber extends not rectilinearly and thereby forms a light trap.

The suction side of the blower for the drier can communicate through an additional pluggable synthetic plastic part with the chamber over the treatment baths.

With the above described advantageous embodiments it is possible to convert development machines which are originally built in accordance with the concept of low bath temperatures, for an operation with high temperatures. For this purpose however an additional synthetic plastic part must be mounted and an edge strip of the baths covering as well as the cover of the input cassette must be replaced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings shows an inventive development machine for developing photographic materials such as for example the materials used in graphic crafts.

DESCRIPTION OF A PREFERRED EMBODIMENT

Figure 1:
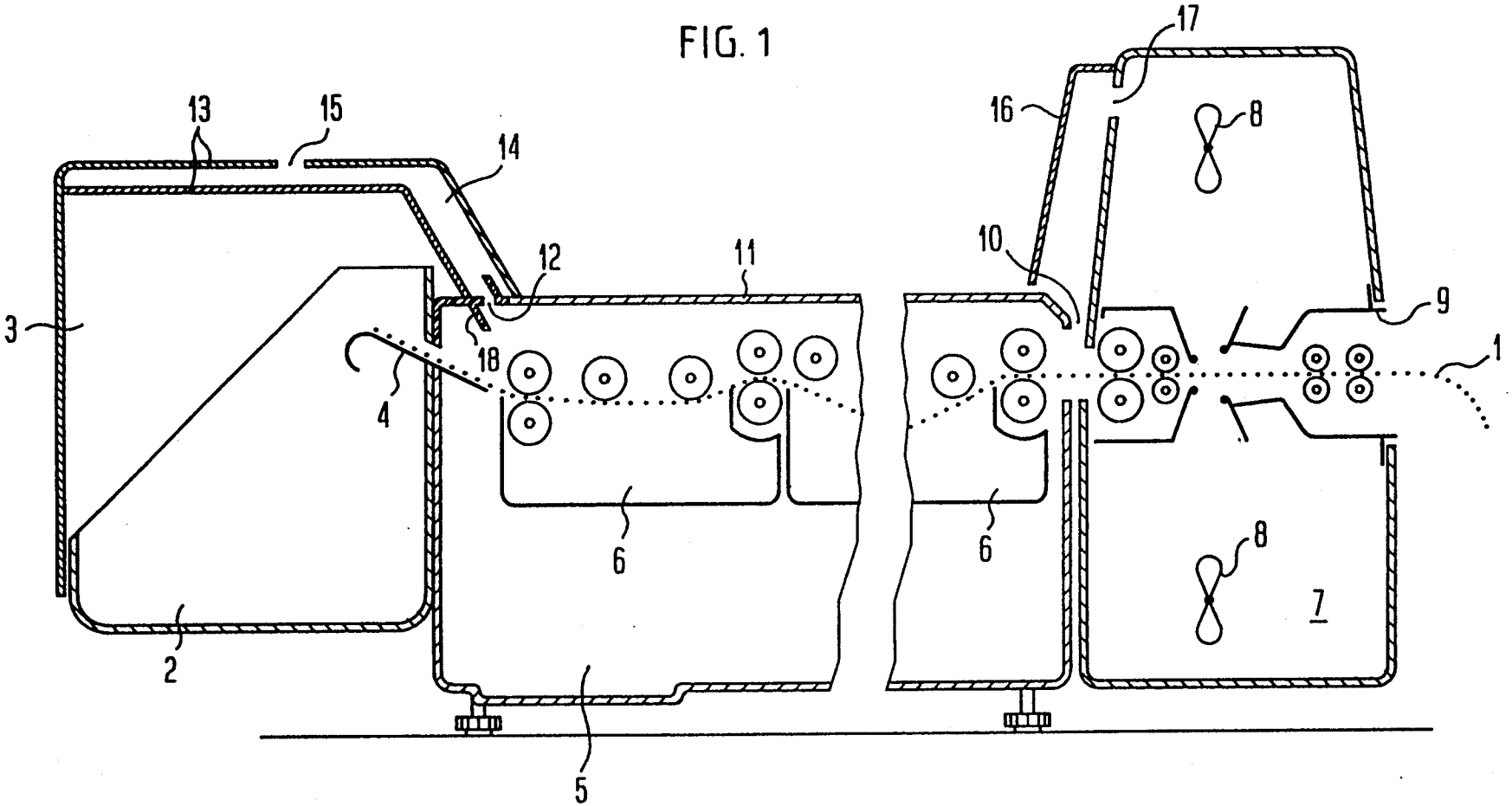

In a development machine in accordance with the present invention a film which after the illumination process is located in a light-tight cassette is introduced with a not shown cassette into a receiving container 2. The receiving container 2 is light-tightly closed with a cover 3. The film passes through the machine over a transport path identified with a dotted line 1. It is first withdrawn from the cassette over an input table 4. The machine has a developing part 5 which includes various treatment reservoirs 6 in which the film is conventionally developed, fixed and watered in two stages. In the drawing however only the first and last treatment reservoirs are shown. As seen in the transporting direction of the film, a drier 7 is located after the developing part 5 of the machine. Hot air is supplied by a blower 8 to the film on its rear and front sides. A slot 10 is further provided in the machine. Due to the slot, the residual air which is pumped against the transporting direction of the film cannot flow into the developing part 5 since it escapes outwardly through the slot 10.

The machine is used also for the developing process, in which the development temperature is approximately 40° C. During such processes the evaporation rate of the development liquid is very high. The vapor flows through the opening over the input table 4 from the warm developing part to the cool receiving container 2. Due to the temperature difference the vapor condenses predominantly directly on the input table 4 and forms droplets there. This leads on the one hand to a predevelopment of the film, and on the other hand, to adhesion of the film to the table 4 so that there are transportation problems. In order to prevent this, an opening 12 is provided in the shown embodiment in a covering 11 which closes the developing part. The cover 3 of the receiving container 2 has an upper limiting wall 13 which is formed as a double wall. Thereby a channel 14 is formed through which the developer-containing air flows from the developing part 5 to an opening 15 and escapes to the atmosphere. The cover 3 is formed so that the passage 14 with its lower opening coincides directly with the opening 12. Due to the curvature of the cover, a light-tightly operating channel 14 is formed. This design prevents depositing of the developer condensate on the input table 4 during the stand-by operation.

When a film is processed in the machine, the developer bath is moved due to the passing film and the increased circulation and thereby the evaporation rate is increased. The running blower 8 activates a small air stream through the developing part 5 and the evaporation rate is further increased. The ventilation through the passage 14 alone is no longer sufficient. In order to prevent a condensation of the vapor on the input table 4 nevertheless, a cover cap 16 is provided to communicate an aspiration opening 17 of the blower 8 through the slot 10 with the inner chamber of the developing part 5. In this way on the one hand pumping of the air from the blower 7 against the film transporting direction into the developing part 5 is prevented. On the other hand, a slight air stream in the transporting direction into the developing part is produced. Therefore during the developing process a condensation on the input table is reliably prevented.

For the reliable operation of the arrangement both features are inevitable, since the first mentioned feature acts exclusively during the stand-by operation, while the last mentioned feature acts only during the developing operation.

In order to convert machines which are not designed for a developing bath with high temperature, the exchange of only a few parts is needed. For this purpose a cover of the film receptacle 2 is replaced by the cover 3 shown in the embodiment with the sample and an edge strip for the covering 11 is replaced with the shown edge strip profile 18 with the ventilation opening 12. The cover cap 16 is formed so that it is additionally fitted on the housing of the drier 7 or clamped with it. In this manner a developing machine can be converted with low expenses, without for example, installing and wiring of an additional blower.

It will be understood that each of the elements described above, or two or more together, may also find a useful application in other types of constructions differing from the types described above.

While the invention has been illustrated and described as embodied in an arrangement for developing photographic sheet carriers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for developing photographic sheet carriers in daylight operation, comprising a closeable receiving container; means for forming a chamber with a plurality of treatment baths; an input table through which a sheet carrier is transported to said treatment baths; transporting means for transporting the sheet carrier through said treatment baths; a drier supplying an air stream to the sheet carrier and having a suction side; a light-tight ventilating device provided in said chamber with said treatment baths and located close to said input table, said chamber with said treatment baths connected with said suction side of said drier; and a cover which covers said receiving container, said cover of said receiving container being double walled and including an outer cover wall which forms a channel, said ventilating device including a ventilating opening provided in a cover for said chamber with treatment bath and also including a ventilating slot provided in said cover wall and communicating with said ventilating opening of said covering through said channel when said receiving container is chosen by said cover.

2. An arrangement as defined in claim 1, wherein said cover is formed so that said channel is formed as a light trap.

3. An arrangement for developing photographic sheet carrier in daylight operation, comprising a closeable receiving container; means for treating the sheet carrier and including a chamber with a plurality of treatment baths, an input table through which a sheet carrier is transported to said treatment baths, and transporting means for transporting said sheet carrier through said treatment baths over a predetermined transporting path; a drier supplying an air stream to the sheet, said chamber having one side adjacent to said receiving container and another side adjacent to said drier; first communicating means for communicating said one side of said chamber with said receiving container so that the sheet carrier is supplied from said receiving container to said chamber through first communicating means; second communicating means communicating said another side of said chamber with said drier so that the sheet carrier is supplied from said chamber into said drier through said second communicating means; light-tight ventilating means which is separate from said first communicating means and including a ventilating passage having a first opening located at said one side of said chamber close to said transporting path of the sheet carrier and a second opening which opens into the atmosphere; and aspirating means which is separate from said second communicating means and including an aspirating passage having a first opening located at said another side close to the transporting path of the sheet carrier and a second opening formed as an aspiration opening of said drier.

4. An arrangement as defined in claim 3; and further comprising a cover arranged to cover said receiving container, said ventilating passage being provided in said cover.

5. An arrangement as defined in claim 4, wherein said cover has an outer cover wall, said second opening of said ventilating passage being provided in said outer cover wall of said cover.

6. An arrangement as defined in claim 3, wherein said drier has a blower having said aspirating opening of said aspirating passage.

* * * * *